US005992289A

United States Patent [19]

George et al.

[11] Patent Number: 5,992,289

[45] Date of Patent: Nov. 30, 1999

[54] FIRING HEAD WITH METERED DELAY

[75] Inventors: Flint R. George, Flower Mound; John D. Burleson, Denton, both of Tex.

[73] Assignee: Halliburton Energy Services, Inc., Dallas, Tex.

[21] Appl. No.: 09/024,419

[22] Filed: Feb. 17, 1998

[51] Int. Cl.[6] ..... B64D 1/04; E21B 29/02; E21B 29/00

[52] U.S. Cl. ..... 89/1.15; 166/297; 166/63; 166/55

[58] Field of Search ..... 166/297, 299, 166/55; 89/1.15; 102/319

[56] References Cited

U.S. PATENT DOCUMENTS

| | | | |
|---|---|---|---|
| 4,911,251 | 3/1990 | George et al. | 175/4.54 |
| 4,924,952 | 5/1990 | Schneider | 175/4.54 |
| 5,161,616 | 11/1992 | Colla | 166/297 |
| 5,167,282 | 12/1992 | Schneider et al. | 166/297 |
| 5,191,936 | 3/1993 | Edwards et al. | 166/297 |
| 5,490,563 | 2/1996 | Wesson et al. | 166/297 |
| 5,540,293 | 7/1996 | Mohaupt | 175/3.5 |

*Primary Examiner*—Charles T. Jordan
*Assistant Examiner*—Jeffrey Howell
*Attorney, Agent, or Firm*—Paul I. Herman; Marlin R. Smith

[57] ABSTRACT

A method of delaying detonation of an explosive device within a subterranean well is provided which is convenient, economical and efficient in its use. In addition, the safety of such operations is enhanced by the construction of a firing head used in the method and engaged with the explosive device in the well. In one described embodiment, the firing head includes a piston reciprocably received in a fluid chamber, and an orifice for metering fluid from the chamber. When the firing head is engaged with the explosive device, weight is applied to the piston, thereby forcing fluid from the chamber through the orifice and producing a time delay. After the piston has traveled a predetermined distance relative to the chamber, its further displacement is relatively unrestricted and the weight drives the piston downwardly to cause detonation of the explosive device.

35 Claims, 12 Drawing Sheets

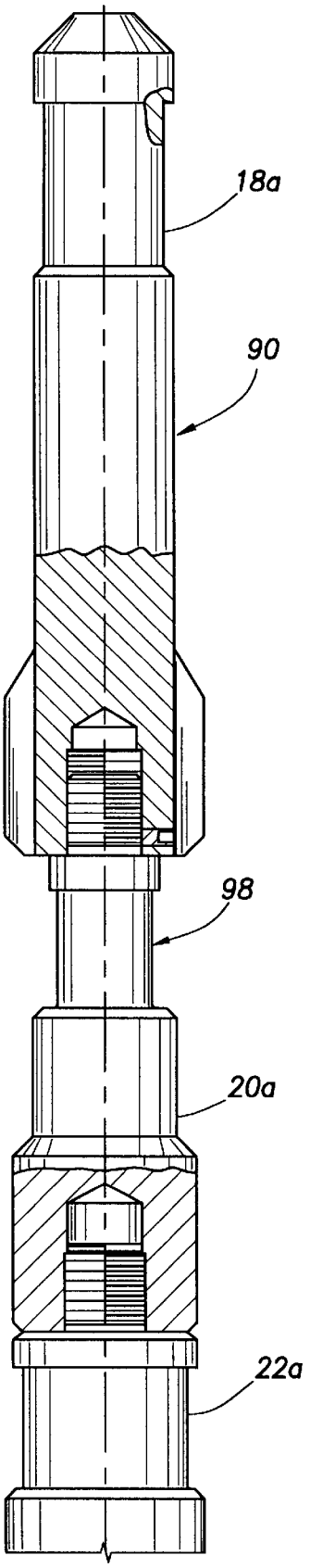
FIG.2A
FIG.2B
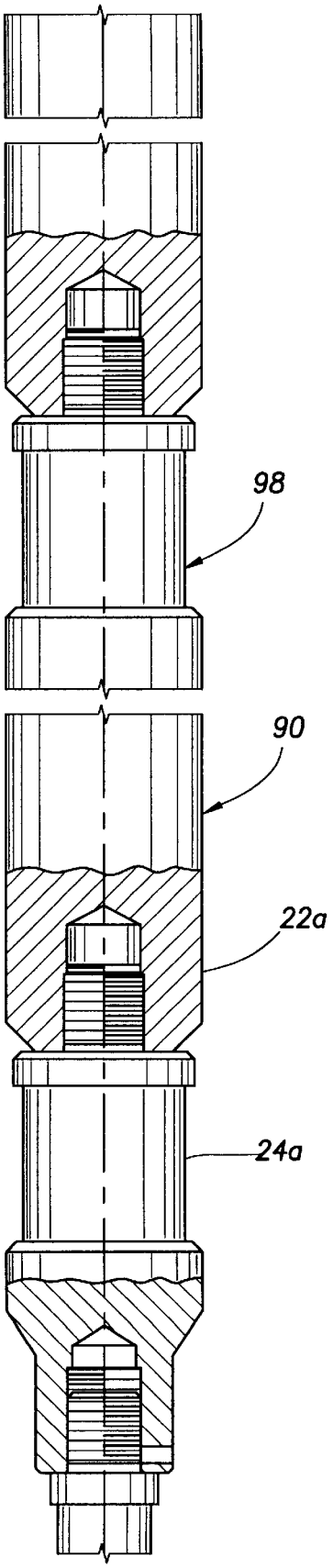

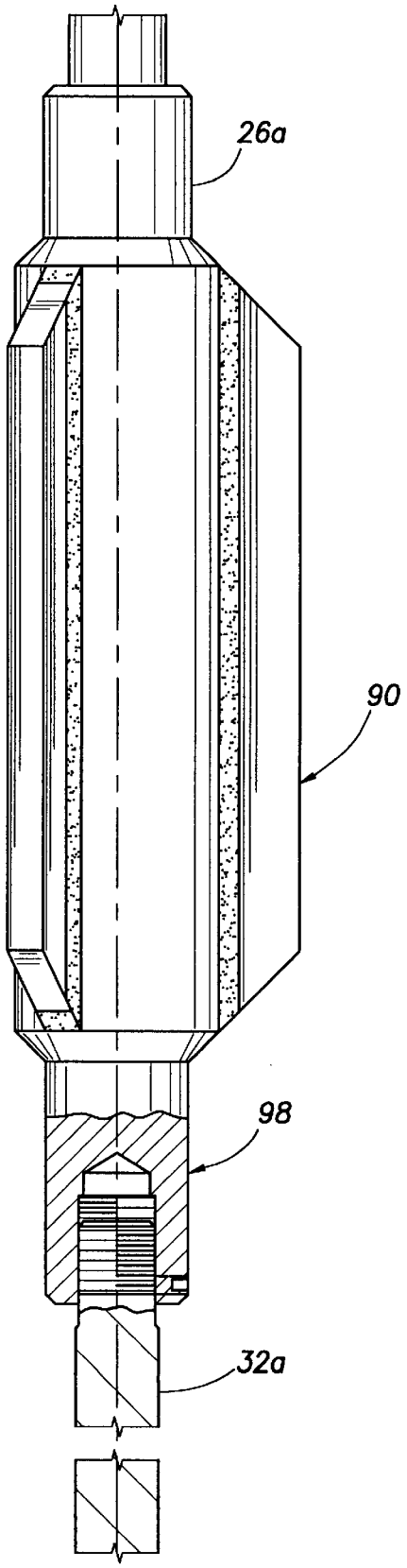
FIG.2C
FIG.2D
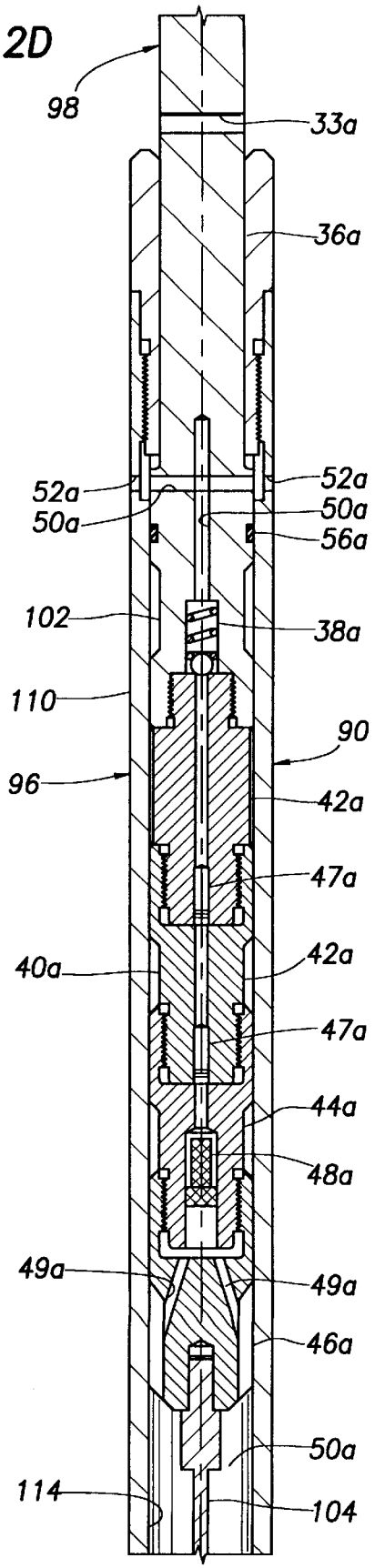

FIRING HEAD WITH METERED DELAY

BACKGROUND OF THE INVENTION

The present invention relates generally to operations performed in subterranean wells and, in an embodiment described herein, more particularly provides a firing head for use in detonating an explosive device in a well.

There is a great potential for damage to a well and injury to personnel in operations which involve detonating an explosive device in the well. Such operations may include perforating protective casing lining the wellbore, severing tubing using an explosive tubing cutter, etc. In these operations, an explosive device and an apparatus for detonating the explosive device are typically conveyed into the well interconnected to each other. In the case of perforating operations, the explosive device is one or more perforating guns and the apparatus used to detonate the gun or guns is known as a firing head.

It is well known in the art to provide a variety of different methods of actuating the firing head. For example, the firing head may be actuated by dropping a bar onto the firing head through tubing extending from the firing head to a wellhead or rig floor at the earth's surface. The bar eventually strikes a firing pin in the firing head, which causes detonation of a detonator explosively coupled to the perforating gun. As another example, fluid pressure may be applied to the tubing, and/or to an annulus surrounding the tubing, to actuate the firing head. As yet another example, electric current may be applied to a blasting cap in the firing head, such as via a wireline extending to the earth's surface.

It is also well known in the art to provide a delay mechanism for delaying the detonation after the firing head has been actuated. This delay permits wireline, slickline, or other equipment to be removed from the well before the perforating guns are detonated, permits a favorable fluid pressure condition to be established before the perforating guns are detonated, etc. Unfortunately, such delay mechanisms sometimes impose an undesirable level of uncertainty into the operation, are at times complex and unreliable, and may not be stopped after the delay mechanism has been actuated.

For example, in a conventional pressure actuated firing head having a hydraulic delay, the firing head is attached to a perforating gun and conveyed into a well. When properly positioned therein, fluid pressure is applied to the firing head to shear one or more shear pins and begin the delay period. A piston in the delay mechanism forces hydraulic fluid through an orifice to produce the delay period, and, when the piston has traveled a predetermined distance, a port is opened, thereby permitting fluid pressure to enter a chamber and drive a firing pin to impact a detonator. In other pressure actuated firing heads, shearing of the shear pins causes initiation of a pyrotechnic time delay which, when it has completed burning, causes detonation of a detonator.

It will be appreciated that several problems exist with these types of firing heads, and other firing heads having delay mechanisms. First, it is difficult to determine from the earth's surface whether the firing head has been actuated at all. Thus, if the perforating gun does not detonate when expected, personnel at the earth's surface will be unsure whether the firing head has been actuated, and whether the firing head and perforating gun may be safely retrieved from the well. If the firing head has been actuated, but a problem has occurred with the delay mechanism, such as a piston binding in a bore, the perforating gun may detonate at any time, possibly causing extensive damage to the well and injury to personnel.

Second, several factors tend to influence typical delay mechanisms, making it difficult to determine the exact delay period to be expected after the firing head has been actuated. For example, the temperature in the well (which may be known only approximately) will influence the speed at which a piston is able to force fluid through an orifice, and will influence the burning rate of a fuse. As another example, the fluid pressure at which the shear pins shear, the fluid pressure applied to shear the pins and the fluid pressure used to drive a piston in a delay mechanism, may not be precisely known. Each of these may influence the initiation of the firing head and start of the delay period.

Third, typical firing heads with delay mechanisms have no provision for retrieving the firing heads to the earth's surface without a perforating gun attached thereto. It would greatly enhance the safety of operations if the delay mechanism could be positively stopped, and if the firing head could be retrieved to the earth's surface separately from the perforating gun.

Of course, the above problems may also apply to other operations involving detonation of an explosive device in a well. Therefore, a solution to these problems would be applicable not only to perforating operations, but to a variety of other operations as well.

From the foregoing, it can be seen that it would be quite desirable to provide an apparatus which does not utilize a complex or unreliable delay mechanism, and which does not introduce unacceptable levels of uncertainty and hazards, but which permits reliable, convenient and efficient detonation of an explosive device in a well. It is accordingly an object of the present invention to provide such apparatus and associated methods of detonating an explosive device.

SUMMARY OF THE INVENTION

In carrying out the principles of the present invention, in accordance with an embodiment thereof, apparatus is provided which permits a firing head having a delay mechanism to be coupled to an explosive device downhole, which permits certainty in its actuation, which has an accurately predictable delay period, which may be stopped at any time, and which may be retrieved to the earth's surface separately from the explosive device. These advantages arc accomplished in the apparatus without the need for a complex delay mechanism. The result is a straightforward and efficient apparatus which is simple and convenient in its operation, and which enhances safety in associated operations. Methods are also provided for performing operations in which an explosive device is detonated in a well.

In one embodiment, a firing head having a delay mechanism is coupled to a perforating gun which has been previously positioned within a well. Alternatively, the firing head could be coupled to the perforating gun and conveyed into the well therewith. After the firing head has been coupled to the perforating gun and both are positioned appropriately in the well, a time delay portion of the firing head is actuated. Upon expiration of a delay period, the firing head detonates the perforating gun.

In one aspect of the present invention, the delay mechanism is actuated by applying a weight to a piston. The piston, being biased to travel downward by the weight, forces a fluid through one or more orifices to produce the delay period. In this manner, the delay period is unaffected by fluid pressure in the well, and the delay mechanism may be stopped at any time by picking up on the weight. Additionally, the firing head may be retrieved from the well after picking up on the weight, with no danger that the delay mechanism will detonate a detonator therein. Thus, the firing head may be safely retrieved separately from the perforating gun.

In another aspect of the present invention, the piston enters an enlarged bore after the delay period has expired. The enlarged bore permits the weight to force the piston downwardly at an increased velocity, since fluid is then permitted to bypass the orifice. The weight is thus permitted to force the piston downwardly at a sufficient velocity to impact a firing pin and cause detonation of the detonator.

In another embodiment of the present invention, an elongated projection is carried with the piston. When the piston enters the enlarged bore, the projection is propelled at an increased velocity toward a complementarily shaped fluid filled receptacle in the firing head. The projection enters the receptacle and produces a pressure increase therein. This pressure increase causes shear pins restraining a firing pin against hydrostatic pressure to shear, permitting the hydrostatic pressure to propel the firing pin toward a detonator.

Methods are also provided in which a firing head is installed in a well and actuated by applying a weight thereto. A delay period is initiated by application of the weight, and the weight further causes detonation of a detonator at the end of the delay period.

These and other features, advantages, benefits and objects of the present invention will become apparent to one of ordinary skill in the art upon careful consideration of the detailed descriptions of representative embodiments of the invention hereinbelow and the accompanying drawings.

BRIEF DESCRIPTION OF THE DRAWINGS

FIGS. 1A–1I are partially cross-sectional and partially elevational views of successive axial sections of a first firing head embodying principles of the present invention;

FIGS. 2A–2J are partially cross-sectional and partially elevational views of successive axial sections of a second firing head embodying principles of the present invention.

DETAILED DESCRIPTION

Figure 1A:
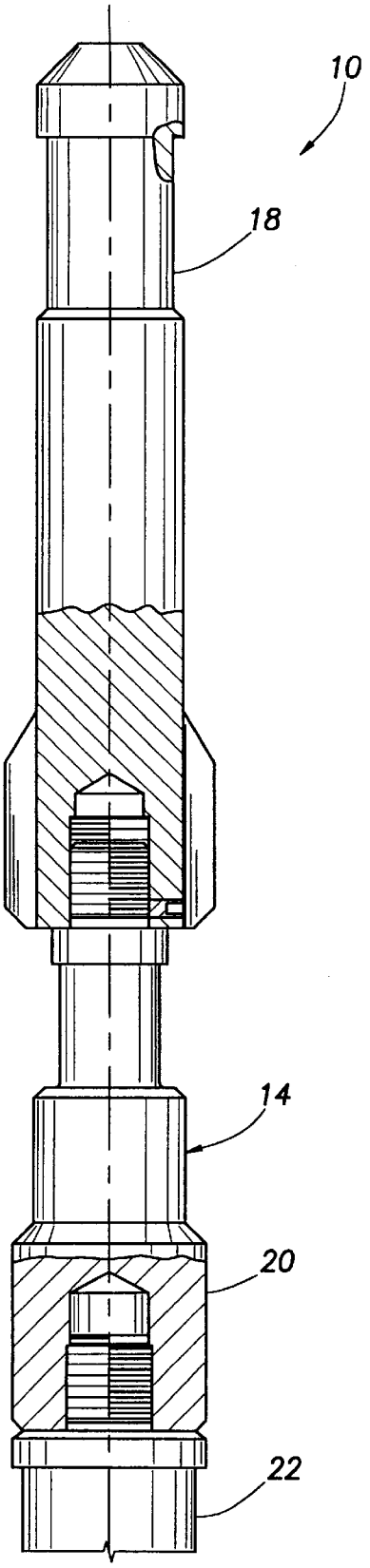
Figure 1B:
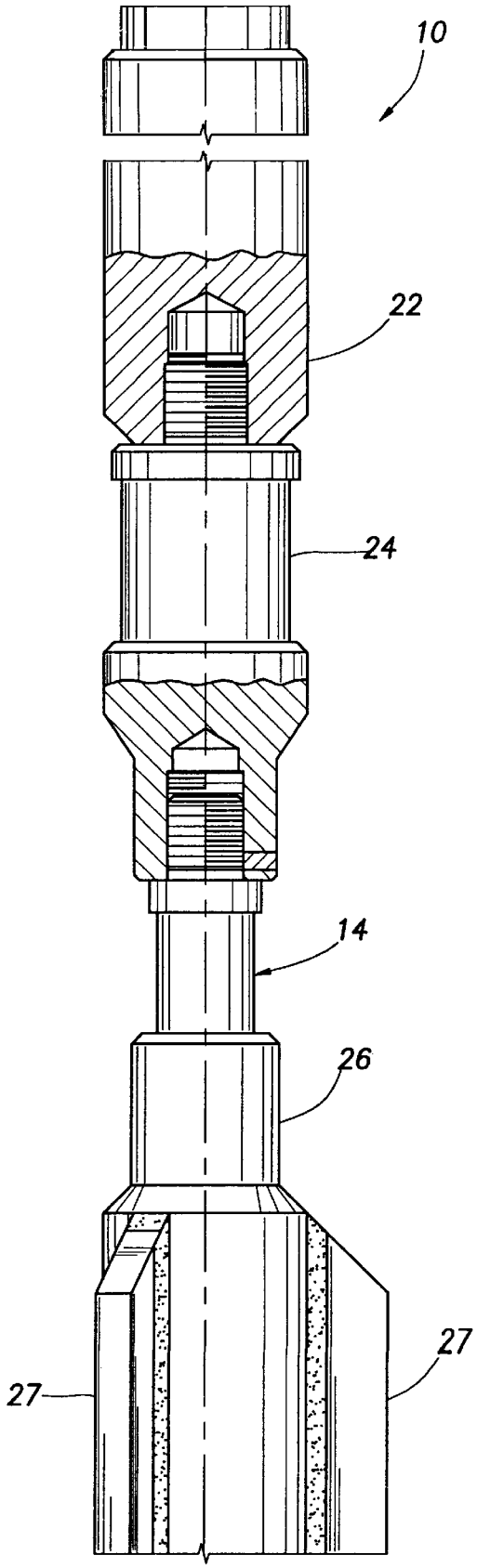
Figure 1C:
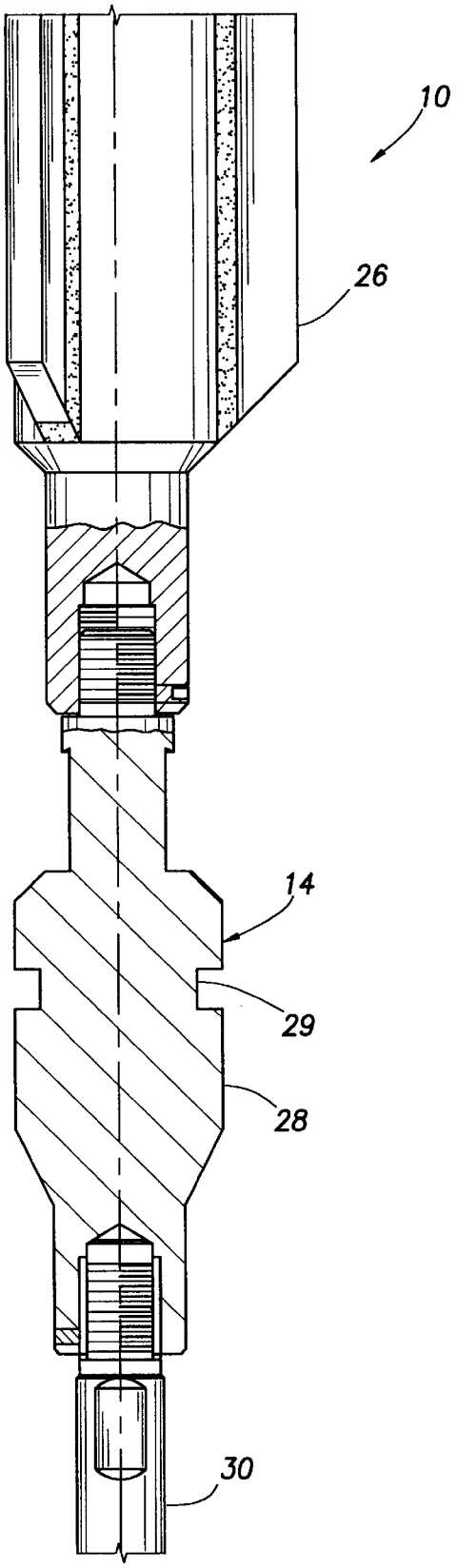
Figure 1D:
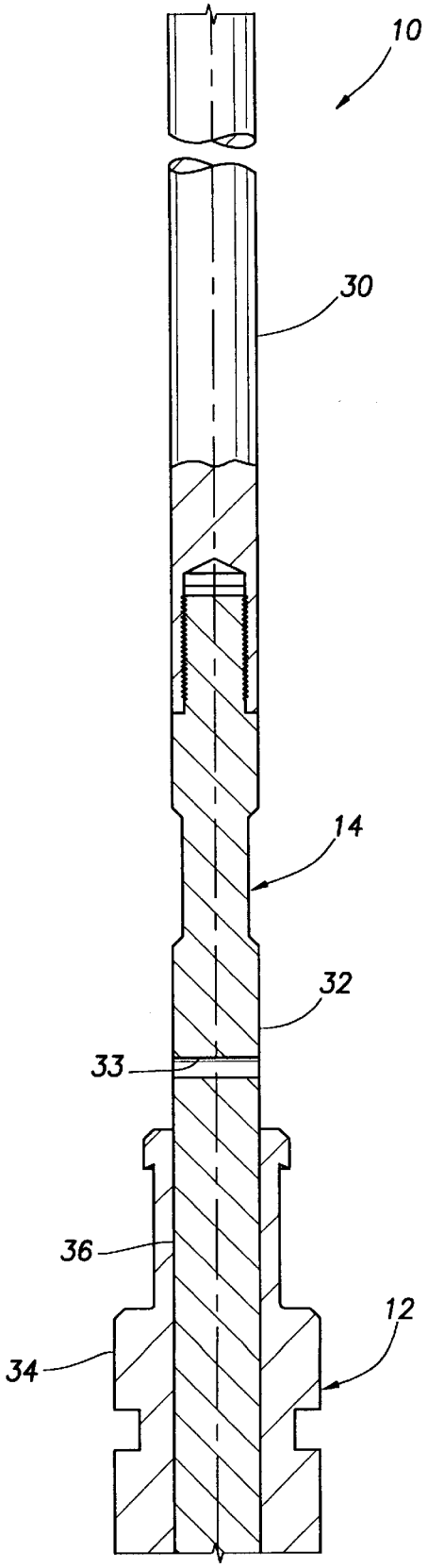
Figure 1E:
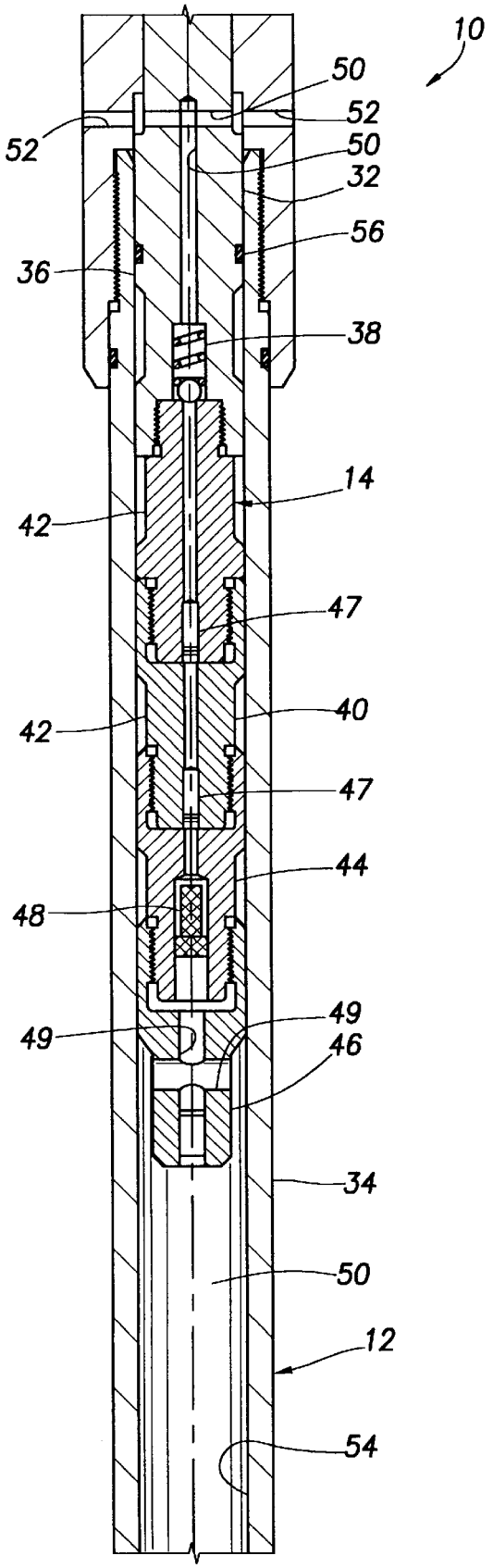
Figure 1F:
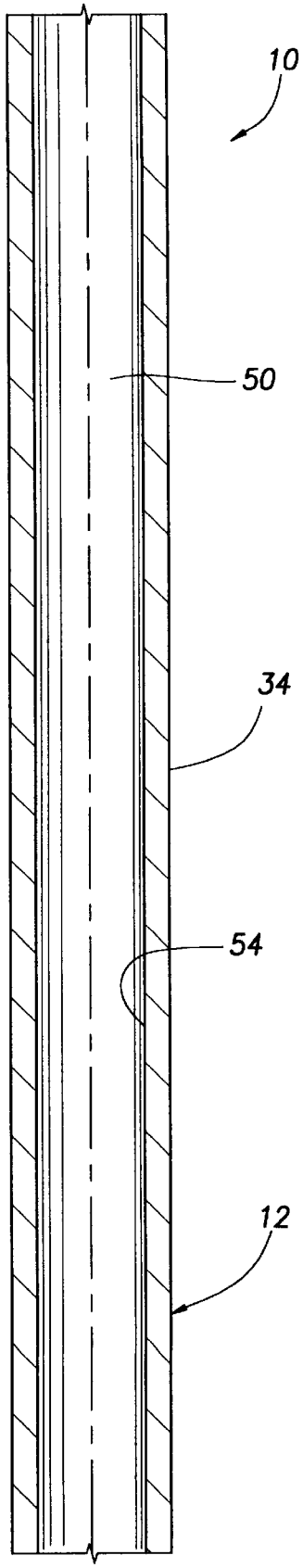
Figure 1G:
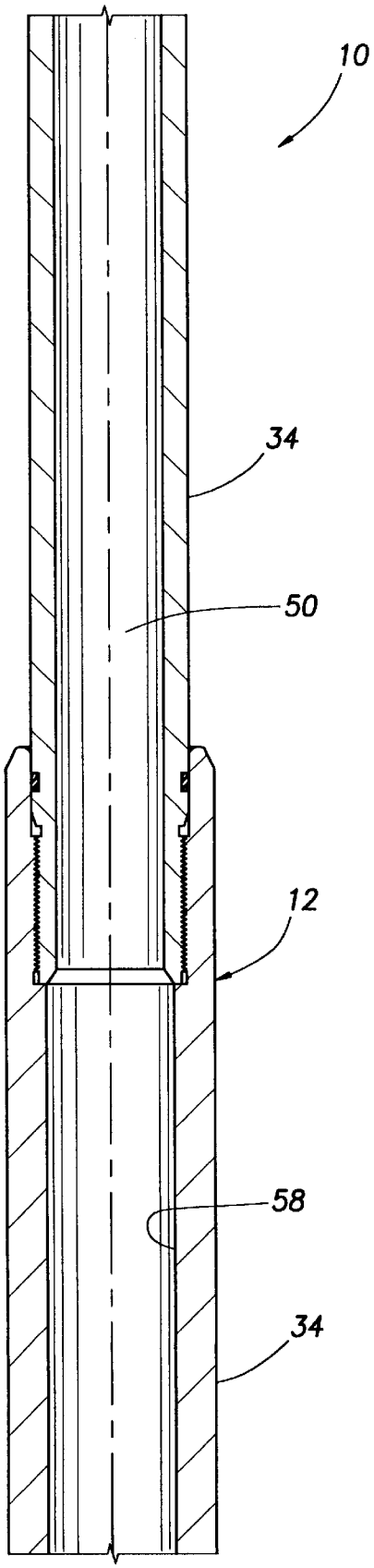

Representatively illustrated in FIGS. 1A–1I is a firing head 10 which embodies principles of the present invention. In the following description of the firing head 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, without departing from the principles of the present invention.

The firing head 10 is described herein as it would be configured for, and used in, detonation of one or more perforating guns in a well. However, it is to be clearly understood that a firing head or other apparatus may be constructed and used in accordance with the principles of the present invention for detonating other types of explosive devices. Therefore, the depicted firing head 10 is only an exemplary embodiment of the present invention.

As representatively illustrated in FIGS. 1A–1I, the firing head 10 is configured for coupling to a perforating gun in a well after the perforating gun has been appropriately positioned within the well and anchored therein. However, it is to be clearly understood that the firing head 10 may be otherwise configured for coupling to an explosive device, and may be coupled to a perforating gun prior to installation of the perforating gun and firing head in the well, without departing from the principles of the present invention.

The firing head 10 includes a stationary assembly 12 and a translating or displacing assembly 14. The stationary assembly 12 is configured at its lower end 16 for coupling to, and cooperative engagement with, a perforating gun within a well. Somewhat similar coupling of a firing head to a perforating gun within a well is described in U.S. Pat. No. 5,490,563, issued Feb. 13, 1996, the disclosure of which is incorporated herein by this reference. Conveyance of the firing head 10 into the well is facilitated by provision of a suitable conventional fishing neck 18 or other attachment device at its upper end for suspending the firing head from slickline, wireline, coiled tubing, etc.

The displacing assembly 14 includes the fishing neck 18 or other attachment device, a coupling 20, one or more elongated rod-like weight bars 22, a coupling 24, a centralizer 26 having radially outwardly extending flutes 27, a suspension coupling 28 having an annular recess 29 formed externally thereon, an extension rod 30, and a piston assembly 32. These elements are threadedly interconnected to each other as shown in FIGS. 1A–1E, but it is to be understood that all of these elements are not necessary in the firing head 10, and that the elements, or any combination of them, may be otherwise interconnected without departing from the principles of the present invention. For example, the couplings 20, 24 could be eliminated by provision of appropriate threads on the fishing neck 18, weight bar 22 and centralizer 26, additional weight bars could be used, etc.

The weight bar 22 is utilized to apply a downwardly biasing force to the piston assembly 32 after the firing head 10 has been coupled to the perforating gun in the well. An opening 33 formed laterally through the piston assembly 32 above the stationary assembly 12 permits a pin (not shown) to be inserted therethrough to prevent significant downward displacement of the displacing assembly 14 relative to the stationary assembly 12 before the firing head 10 is installed in the well. In a manner that will be more fully described below, the weight of the weight bar 22 influences a delay period produced when the weight is applied to the piston assembly 32. It will be readily appreciated by a person of ordinary skill in the art that the weight of the weight bar 22 may be precisely controlled, may be known before the firing head 10 is actuated, and therefore aids in precisely controlling the delay period produced thereby.

Additionally, the weight bar 22 is conveniently picked up by using the fishing neck 18 and conventional fishing/latching tools well known to those of ordinary skill in the art, enabling the delay period to be stopped at any time, and enabling the firing head to be retrieved from the well safely, without any danger that the delay period will again begin to run. Furthermore, it will be readily appreciated that the amount of weight applied to the piston assembly 32 (and, thus, the length of the delay period) may be conveniently varied by adding or removing additional weight bars 22 to or from the displacing assembly 14.

The centralizer 26 is used to centralize the displacing assembly 14 within any tubular string in which the firing head 10 is installed downhole. This operates to prevent binding of the piston assembly 32 within a housing assembly 34 of the stationary assembly 12. In this manner, reliability of the firing head 10 is enhanced and the delay period is accurately predictable. As described more fully below, the firing head 10 is configured for coupling to a perforating gun within casing lining a wellbore, but it is to be understood that the firing head may be coupled to an explosive device within a tubing string, in an open hole, etc., without departing from the principles of the present invention.

The suspension coupling 28 permits the displacing assembly 14 to be suspended above the tubular string in which the firing head 10 is installed at the earth's surface. Such suspension of the coupling 28 allows the centralizer 26, weight bar 22, couplings 20, 24 and fishing neck 18 to be assembled to the firing head 10 at the earth's surface prior to installation of the firing head in the tubular string and without causing initiation of the delay period.

The piston assembly 32 includes an axially elongated piston 36, an integral check valve 38 and a fluid metering device 40. The fluid metering device 40 is threadedly connected to the piston 36 at its lower end and includes one or more orifice assemblies 42, a filter 44 and a closure 46. The orifice assemblies 42, filter 44 and closure 46 are threadedly interconnected to each other and may be sealingly interconnected to each other by providing conventional orings or other sealing devices thereon.

Each orifice assembly 42 includes a device 47 for restricting the flow of fluid therethrough. In the representatively illustrated orifice assemblies, the devices 47 are Visco Jets commercially available from Lee Co. A fluid filtering screen 48 in the filter 44 is also available from Lee Co. Of course, in a firing head constructed in accordance with the principles of the present invention, a flow restricting device may be no more than a small opening and it is not necessary for the fluid flowing therethrough to be filtered.

Thus, the fluid metering device 40 may include more, fewer or different elements than those illustrated. Additionally, it is not necessary for the fluid metering device 40 to include multiple orifice assemblies 42 in keeping with the principles of the present invention, but it will be readily appreciated that, by varying the number and individual flow restrictions of the orifice assemblies, the delay period may be conveniently adjusted prior to installation of the firing head 10 in the well.

The closure 46 has lateral and axial fluid passages 49 formed therein for admitting fluid 50 from within the housing assembly 34 into the fluid metering device 40. The check valve 38 is configured to permit flow of the fluid 50 through the fluid metering device 40 into the piston 36, but to prevent the fluid from flowing in an opposite direction. The piston 36 has lateral and axial fluid passages 50 formed therein for permitting fluid flow through the piston from the check valve 38 to the exterior of the firing head 10 via lateral fluid passages 52 formed through the housing assembly 34.

Figure 1H:
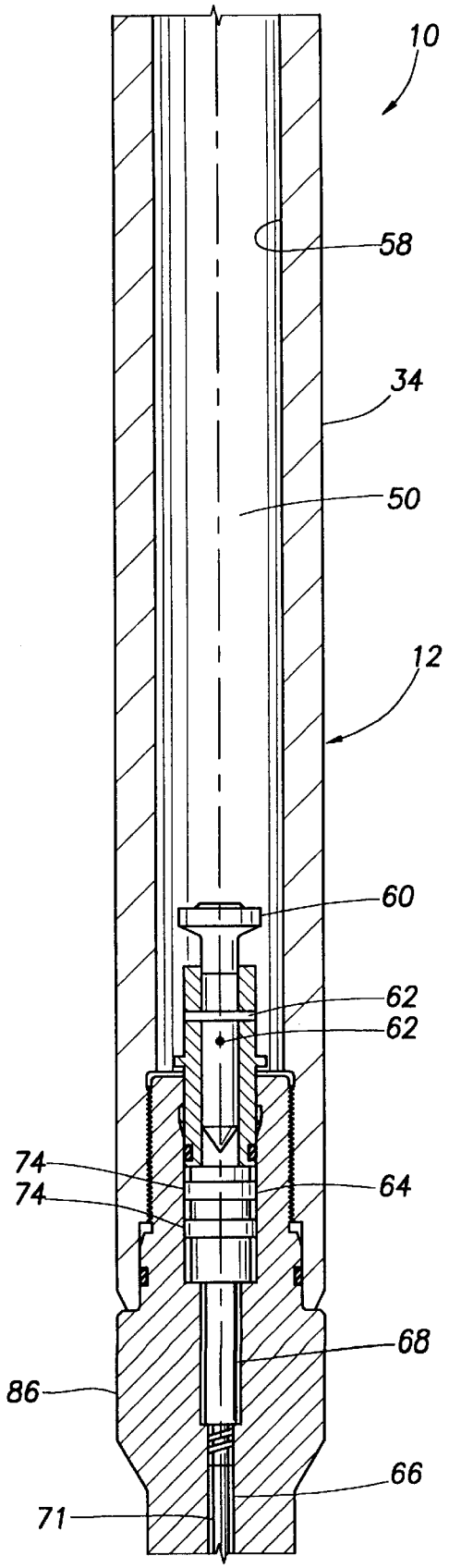
Figure 11:
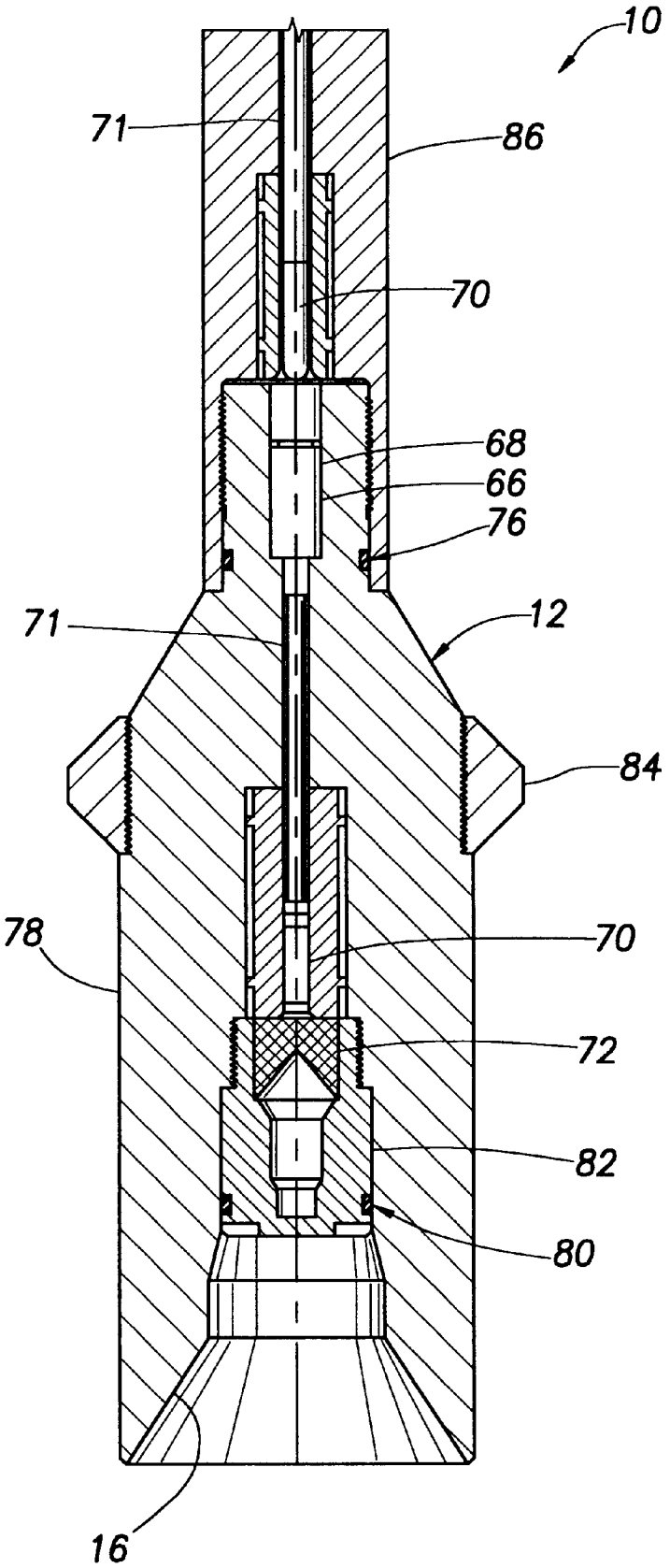
Figure 2E:
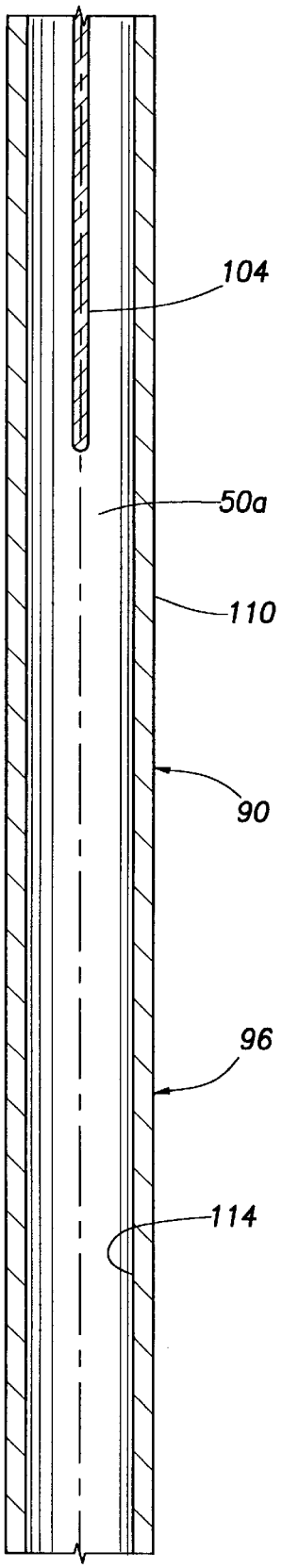
Figure 2F:
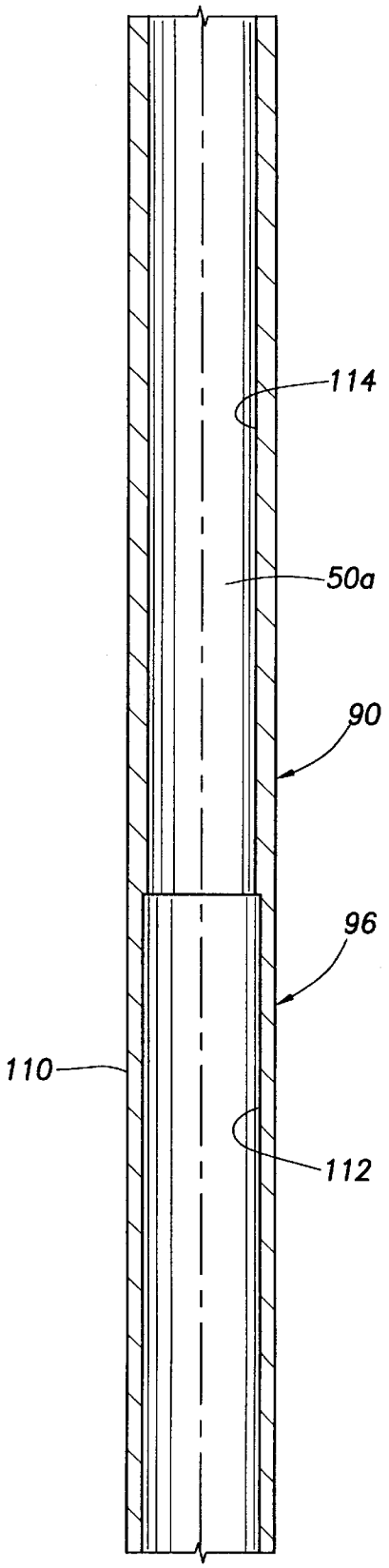
Figure 2G:
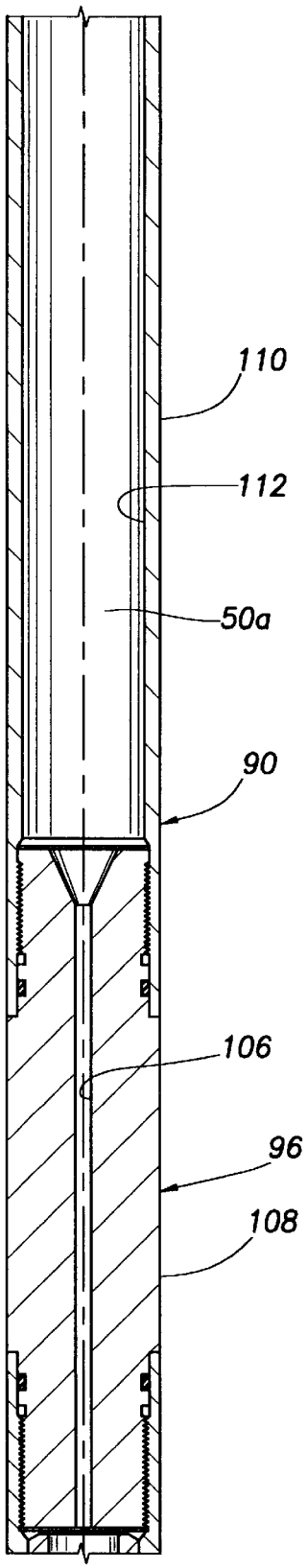
Figure 2H:
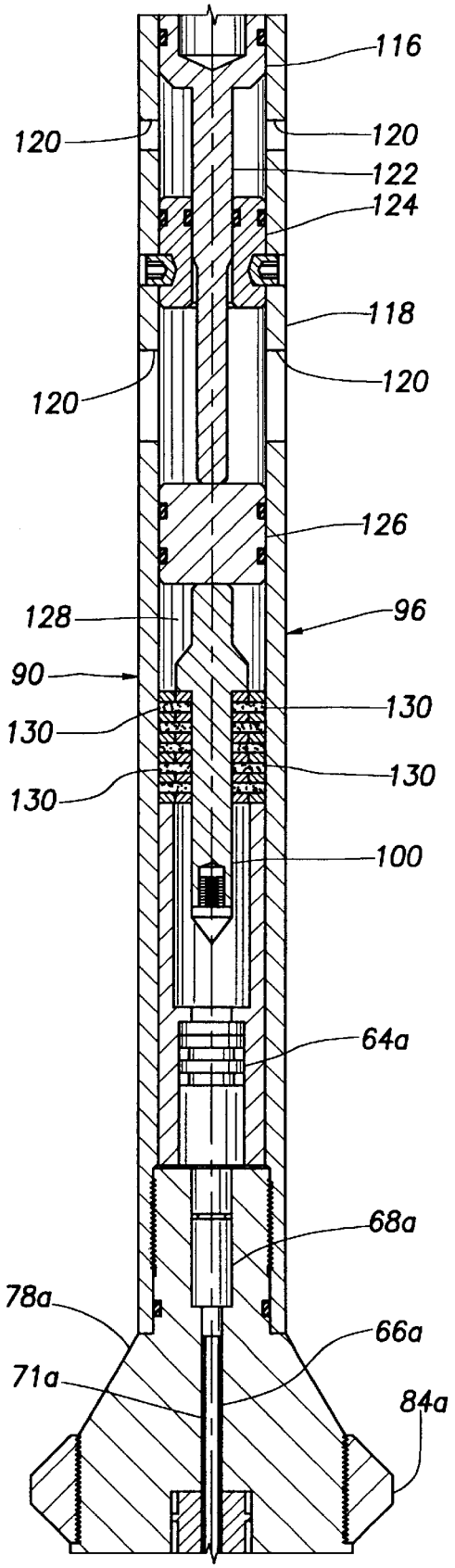
Figure 21:
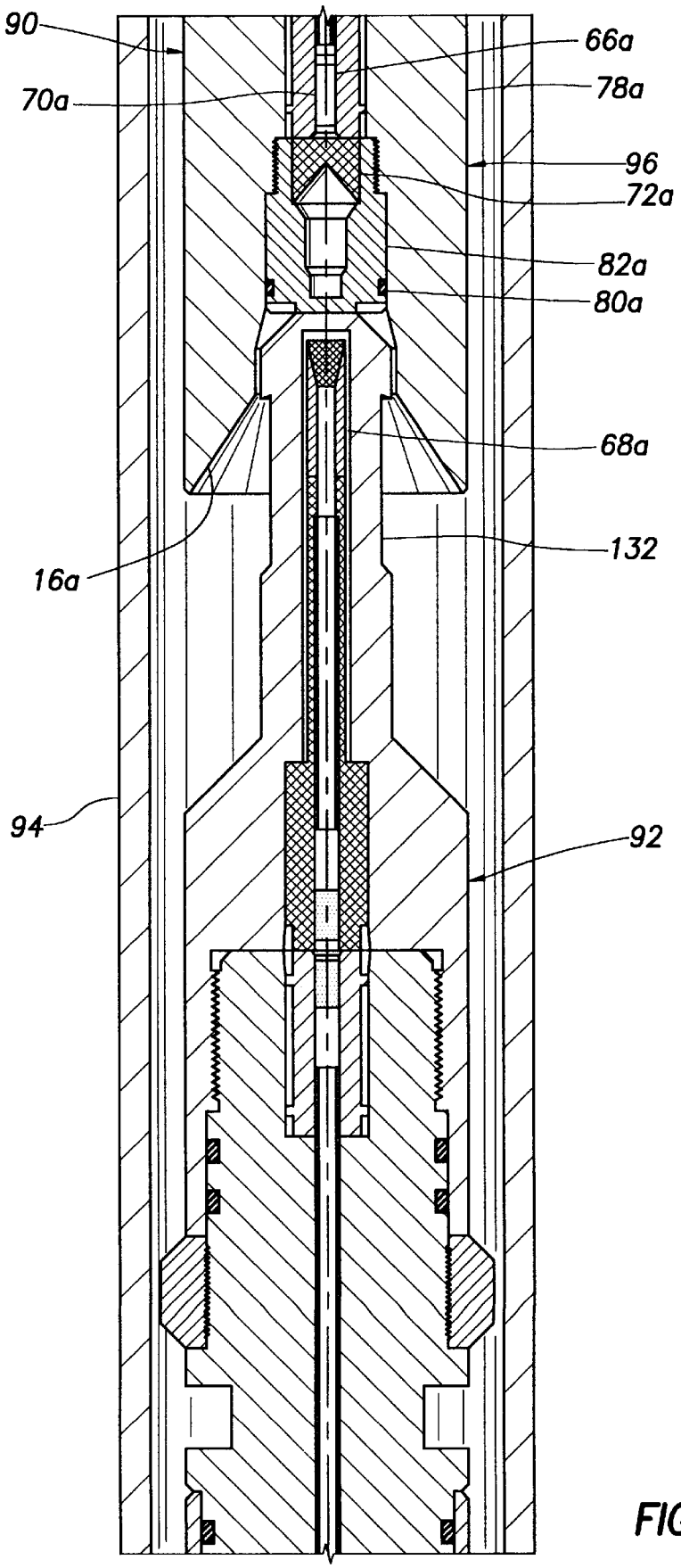
Figure 2J:
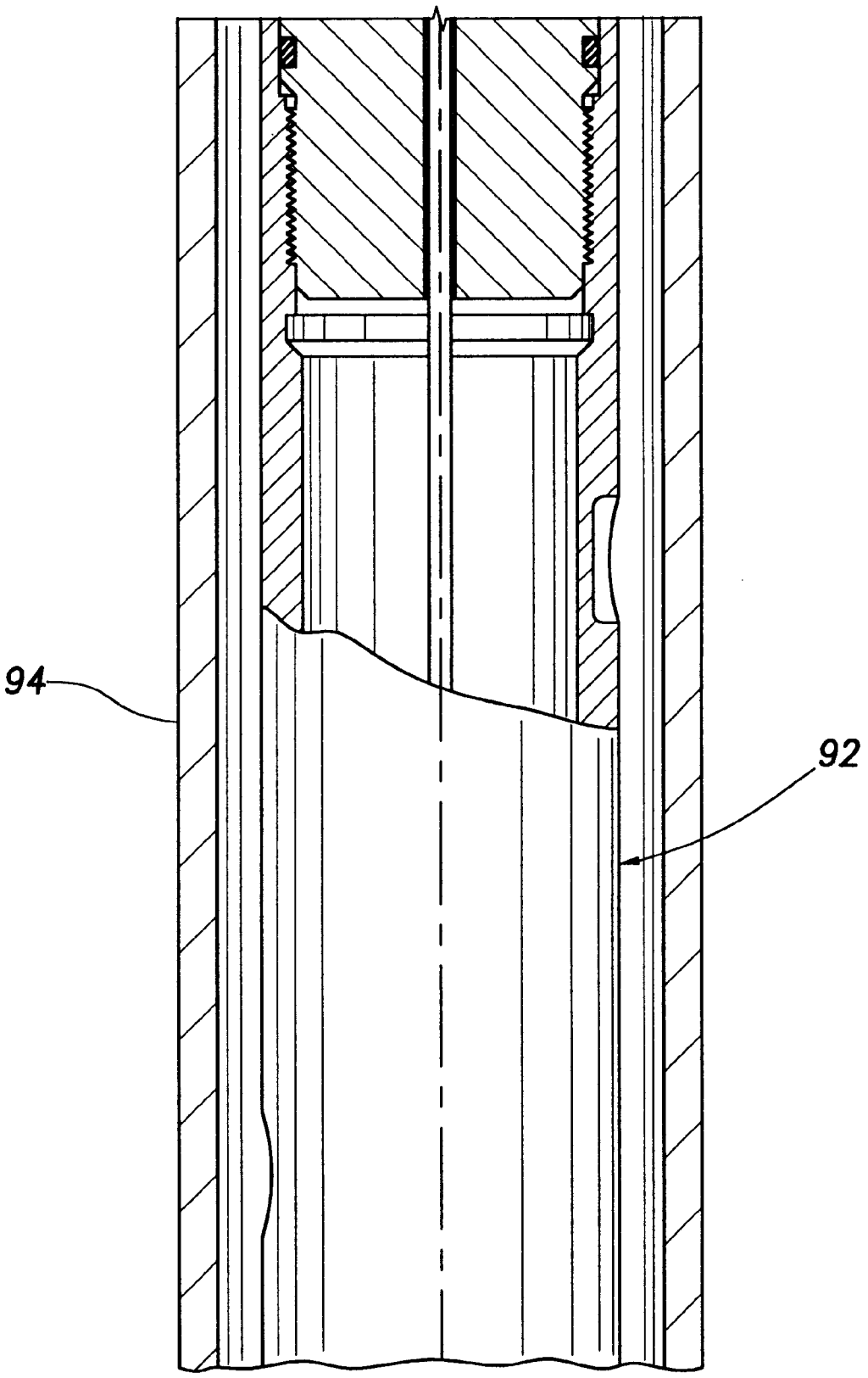

The piston 36 carries a circumferential seal 56 externally thereon for sealingly engaging an axial bore 54 of the housing assembly 34, the bore defining a fluid chamber within the housing assembly axially between the piston assembly 32 and a detonator housing 86 threadedly attached to a lower end of the housing assembly (see FIGS. 1H & 1I). With the piston 36 thus sealingly engaging the bore 54, it will be readily appreciated by one of ordinary skill in the art that if the piston assembly 32 is displaced axially downward into the housing assembly 34 by the weight applied thereto as described above, the fluid 50 contained in the fluid chamber of the housing assembly will be forced into the fluid passages 49 of the closure 46, through the filter 44, through the orifice assemblies 42, through the check valve 38, through the fluid passages 50, 52 and to the exterior of the firing head 10. If, however, the seal 56 does not sealingly engage the bore 54, it will also be appreciated that the fluid 50 will be permitted to bypass the metering device 40 and piston 36 by flowing radially between the piston assembly 32 and bore to the fluid passages 52, thereby permitting the weight applied to the piston assembly to increase its downwardly directed velocity.

Of course, the piston assembly 32 and metering device 40 may be differently constructed without departing from the principles of the present invention. For example, it is not necessary for the metering device 40 to be attached to, or carried on, the piston assembly 32. The metering device 40 could be made a portion of, or be attached to, the housing assembly 34, etc.

The seal 56 carried on the piston 36 is preferably a low friction seal. This permits more accurate prediction of the delay period produced by displacement of the piston 36 within the housing assembly 34. A suitable low friction seal for use as the seal 56 is known as a cap seal and is available from Greene Tweed & Co., Inc. of Houston, Texas. However, it is to be understood that other seals, and other types of seals, may be used for the seal 56 without departing from the principles of the present invention.

The housing assembly 34 includes a radially enlarged axial bore 58 positioned axially downward from the bore 54. The enlarged bore 58 has an inner diameter large enough so that the seal 56 will not sealingly engage the bore 58 when the piston 36 is disposed therein. Thus, when the piston 36 has displaced axially downward sufficiently far for the seal 56 to enter the enlarged bore 58, the fluid 50 is permitted to bypass the metering device 40 and piston 36, and the displacing assembly 14 displaces downwardly with an increased velocity. Thus, it will be readily appreciated that the length of the delay period may be conveniently varied by changing the axial length of the bore 54.

Note that, as depicted in FIGS. 1E–1H, the bores 54, 58 are formed in separate tubular elements of the housing assembly 34. It is not necessary for the bores 54, 58 to be formed in separate elements in keeping with the principles of the present invention. For example, the bores 54, 58 could be formed in a single tubular element of the housing assembly 34.

When the seal 56 enters the enlarged bore 58, the downward velocity of the displacing assembly 14 increases, due to the decreased restriction to flow of the fluid 50 to the fluid passages 52. A firing pin 60 is positioned within the bore 58, so that, when the displacing assembly 14 displaces downwardly through the bore 58, it will eventually impact the firing pin. In this manner, the velocity of the displacing assembly 14 is increased before it impacts the firing pin 60. However, it is to be clearly understood that it is not necessary for the velocity of the displacing assembly 14 to increase before impacting the firing pin 60. For example, the displacing assembly 14 could displace downwardly at a relatively constant velocity before contacting the firing pin 60. As another example, the displacing assembly 14 could strike a detonator directly, without the need to strike a separate firing pin. In that case, a firing pin could be attached to a lower end of the closure 46 for striking the detonator.

When the displacing assembly 14 impacts the firing pin 60, one or more shear pins 62 releasably securing the firing pin shear, permitting the firing pin to displace downwardly and impact a conventional detonator 64. The detonator 64 detonates and transfers this detonation to an explosive train 66, which may include one or more detonation receivers 68, boosters 70, explosive cord 71 and a shaped charge 72. Of course, more or less of these elements, additional or fewer elements, or any combination, may be included in the explosive train 66 without departing from the principles of the present invention.

The explosive train 66 is isolated from fluid communication with the exterior of the firing head 10 and with the interior of the housing assembly 34 by seals 74 carried externally on the detonator 64, a seal 76 carried externally on a transfer skirt 78 of the stationary assembly 12 threadedly attached to a lower end of the detonator housing 86, and a seal 80 carried externally on a shaped charge housing 82 containing the shaped charge 72 within the transfer skirt. In a manner that will be more fully described below, detonation of the shaped charge 72 causes transfer of the detonation to a perforating gun to which the firing head 10 is coupled. A centralizing ring 84 threadedly attached to the transfer skirt 78 centralizes the stationary assembly 12 within the tubular string in which the firing head 10 is installed.

Thus, the firing head 10 is conveyed into the well after the perforating gun is positioned therein. The displacing assembly 14 is then released from whatever means was used to suspend and convey the firing head 10 into the well. Such release of the displacing assembly 14 applies the weight of the weight bar 22 (and other elements of the displacing assembly) to the piston assembly 32 and begins the delay period. Weight applied to the piston assembly 32 biases the piston assembly downward, forcing the fluid 50 to flow through the metering device 40 while the seal 56 is sealingly engaged within the bore 54. When the piston assembly 32 has displaced downwardly sufficiently far for the seal 56 to enter the enlarged bore 58, the displacing assembly 14 displaces downwardly at an increased velocity and eventually impacts the firing pin 60. The impact on the firing pin 60 causes detonation of an explosive train 66, thereby causing detonation of a perforating gun coupled to the firing head 10 and ending the delay period.

If, for whatever reason, it is desired to stop the delay period to prevent detonating the perforating gun, or to permit safe retrieval of the firing head 10 before detonation of the perforating gun, the fishing neck 18 may be latched onto and the displacing assembly 14 may be suspended from slickline, wireline, coiled tubing, etc. and retrieved to the earth's surface. By suspending the displacing assembly 14, weight is removed from the piston assembly 32, and its downward displacement is stopped. This method also separates the firing head 10 from the perforating gun, thereby eliminating any possibility that the firing head could detonate the perforating gun during retrieval of the firing head.

Note that there are a variety of methods available to adjust the length of the delay period. The viscosity of the fluid 50 may be increased to increase the delay period, and the viscosity may be decreased to decrease the delay period. The number and relative restriction to flow therethrough of the flow restriction devices 47, the length of the bore 54, the number and weight of the weight bars 22, etc. may be varied to correspondingly vary the delay period. All of these may be readily controlled at the earth's surface before the firing head 10 is installed, thereby permitting an enhanced degree of control over the length of the delay period.

Of course, the viscosity of the fluid 50 may change with a change in its temperature when the firing head 10 is installed in the well. However, fluids, such as silicone-based fluids available from Dow Chemical Corp., are available which have viscosities that do not change significantly over the range of temperatures commonly encountered in wells. Other fluids, such as synthetic hydraulic fluid, water, etc. may also be used.

Referring additionally now to FIGS. 2A–2J, a firing head 90 embodying principles of the present invention is representatively illustrated coupled to a perforating gun 92 within a casing 94 or other tubular string in a well. Elements shown in FIGS. 2A–2J which are similar to those previously described are indicated using the same reference numbers, with an added suffix "a".

The firing head 90 includes a stationary assembly 96 and displacing assembly 98 which are in many respects similar to the previously described stationary assembly 12 and displacing assembly 14. However, the firing head 90 differs in at least one substantial respect from the firing head 10 in that the displacing assembly 98 does not directly impact a firing pin upon completion of the delay period. Instead, the displacing assembly 98 causes a pressure increase within the stationary assembly 96 upon completion of the delay period, which then causes a firing pin 100 to impact the detonator 64*a*, aided by hydrostatic fluid pressure within the casing 94.

The displacing assembly 98 includes a piston assembly 102, which includes the piston 36*a*, metering device 40*a* and closure 46*a* (shown in FIG. 2D with an alternate configuration of the fluid passages 49*a*). In addition, the piston assembly 102 has an axially elongated projecting member 104 threadedly attached to the closure 46*a* and extending downwardly therefrom. The projection 104 is complementarily shaped relative to an axial bore 106 formed internally in a receptacle 108 included in a housing assembly 110 of the stationary assembly 96. The receptacle 108 is positioned axially downward from an enlarged axial bore 112 formed internally in the housing assembly 110.

In a manner similar to that described above for the firing head 10, the seal 56*a* of the piston assembly 102 initially sealingly engages an axial bore 114 formed internally in the housing assembly 110. When the firing head 90 is actuated by applying the weight of the displacing assembly 98 to the piston assembly 102, the displacing assembly then displaces axially downward, with the fluid 50*a* being forced through the metering device 40*a* to regulate the downward velocity of the displacing assembly. Eventually, the seal 56*a* enters the enlarged bore 112 and the fluid 50*a* is permitted to bypass the piston assembly 102, thereby allowing the downward velocity of the displacing assembly 98 to increase.

The projection 104 then enters the bore 106 of the receptacle 108 and causes an increase in the pressure of the fluid 5*a* below the projection. The increased fluid pressure is applied to an upper face of a previously pressure-balanced piston 116 sealingly and axially reciprocably engaged within a generally tubular piston housing 118 threadedly attached to the housing assembly 110. It will be readily appreciated by a person of ordinary skill in the art that, when the firing head 90 was initially installed in the well, the fluid 50*a* had a pressure equal to that within the casing 94 external to the firing head 90, and that after actuation of the firing head 90 the fluid 50*a* will experience a small increase in pressure due to the weight of the displacing assembly 98 being applied thereto, but that upon the projection 104 entering the bore 106 at an increased velocity, a substantial increase in the pressure of the fluid 50*a* below the projection will be experienced (due to the weight of the displacing assembly 98 being supported by a column of the fluid having a substantially decreased area). Preferably, the projection 104 is very closely fitted in the bore 106 to aid in producing the substantial increase in pressure of the fluid 50*a*.

The piston 116 is exposed to fluid pressure in the casing 94 external to the firing head 90 via openings 120 formed laterally through the piston housing 118. A downwardly extending rod portion 122 of the piston 116 extends through an annular member 124 secured to the piston housing 118 and contacts a floating piston 126 sealingly and axially reciprocably received within the piston housing.

The floating piston 126 isolates an atmospheric chamber 128 within the piston housing 118 below the piston from the fluid pressure in the casing 94 external to the firing head 90. Shear pins 130 releasably secure the firing pin 100 against downward displacement due to axial contact between the piston 126 and the firing pin. Preferably, the shear pins 130 are of sufficient size and number to secure the firing pin against displacement when the fluid pressure in the casing 94 external to the firing head 90 is applied to the upper face of the piston 126, but the shear pins will shear when a significant increase in pressure of the fluid 50*a* is created by the projection 104 entering the bore 106 as described above.

It will be readily appreciated by one of ordinary skill in the art that when the significant increase in pressure of the fluid 50*a* is applied to the upper face of the piston 116, the piston 116 (via the rod portion 122) will apply a downwardly directed force to the piston 126. This downwardly directed force, in combination with a force produced by fluid pressure applied to the upper face of the piston 126, causes shearing of the shear pins 130 and drives the firing pin 100 axially downward to impact the detonator 64*a*.

Note that it is not necessary for fluid pressure in the casing 94 external to the firing head 90 to be present for the firing head to be used satisfactorily. The shear pins 130 could be of sufficient size and number to shear upon production of the significant increase in pressure of the fluid 50*a* as described above, without also requiring fluid pressure to be applied to the upper face of the floating piston 126. Alternatively, a firing head could be constructed similar to the firing head 90, except that the openings 120 in the piston housing 118, the annular member 124, and the floating piston 126 could be eliminated, and the rod portion 122 could contact the firing pin 100 directly. These and other changes to the firing head 90 may be made without departing from the principles of the present invention.

Detonation of the detonator 64*a* causes detonation of the explosive train 66*a*. Detonation of the explosive train 66*a*, in turn, causes the shaped charge 72*a* to explosively penetrate the shaped charge housing 82*a* and transfer the detonation to a detonation receiver 68*a* positioned within an upper end of an axially elongated stinger 132 threadedly attached as an upper end of the perforating gun 92. The stinger 132 is received axially within a lower end of the transfer skirt 78*a*, and is explosively coupled thereto due to the axial alignment of the shaped charge 72*a* with the detonation receiver 68*a* in the stinger. Detonation of the detonation receiver 68*a* in the stinger 132 causes detonation of the remainder of the perforating gun 92 and any additional perforating guns coupled therebelow.

Thus, the firing head 90 differs in one significant respect from the firing head 10 in that the displacing assembly 98 does not directly or indirectly impact the firing pin 100. Instead, fluid pressure external to the firing head 90, in combination with a significant increase in fluid pressure within the firing head, is used to propel the firing pin to impact the detonator 64*a*

Figure 3:
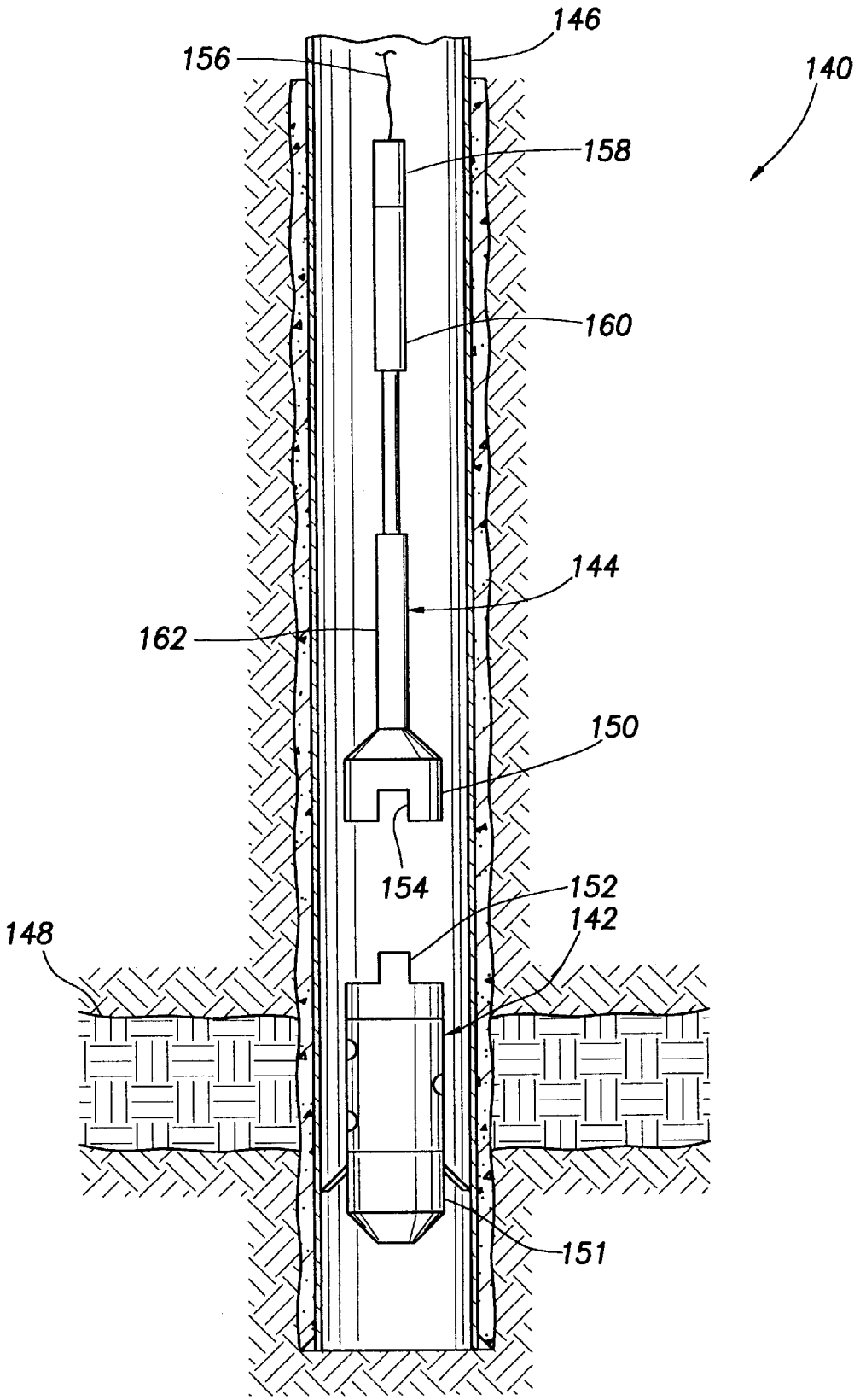
FIG. 3 is a schematic representation of a method embodying principles of the present invention.

Referring additionally now to FIG. 3, a method 140 of detonating an explosive device within a subterranean well is representatively and schematically illustrated. In the method 140, an explosive device, representatively a perforating gun 142, is positioned within the well prior to coupling a firing head 144 thereto. As described below, the method 140 is performed to perforate casing 146 lining the well opposite a particular formation or interval of a formation 148 intersected by the well. It is to be clearly understood, however, that the method 140 may be performed with other types of explosive devices, may be performed for other purposes, and that the firing head 144 or other detonation device may be otherwise coupled to the explosive device, without departing from the principles of the present invention.

The perforating gun 142 is conveyed into the well by slickline, wireline, coiled tubing, or other conveyance and positioned opposite the formation 148. The perforating gun 142 is then anchored in position by a gun hanger 151 or other anchoring device attached thereto. Alternatively, the gun 142 may be rested on top of a sump packer, casing shoe, latched within a nipple, etc. Thus, any manner of positioning the perforating gun 142 within the well may be utilized without departing from the principles of the present invention.

When the perforating gun 142 has been appropriately positioned within the well, the firing head 144 is conveyed into the well and coupled to the perforating gun. For this purpose, the firing head 144 has a lower housing 150 configured for cooperative engagement with an upper stinger 152 of the perforating gun 142. Note that, in FIG. 3, the housing 150 is shown as having a recess 154 formed therein for complementary engagement with the axially elongated stinger 152, but it will be readily appreciated that the recess could be disposed on the upper end of the perforating gun 142 and the stinger 152 could be disposed on the lower end of the housing 150.

Each of the previously described firing heads 10, 90, or another firing head, could be used for the firing head 144 in the method 140. The firing head 144 is conveyed into the well suspended from wireline, coiled tubing, slickline 156, or other conveyance. The firing head 144 is then coupled to the perforating gun 142 by, for example, receiving the stinger 152 within the recess 154.

After coupling the firing head 144 to the perforating gun 142, the firing head is released from the slickline 156 by, for example, disengaging a conventional fishing or latching tool 158 attached to the slickline from the firing head. For this purpose, the firing head 144 may include a fishing neck or other attachment device (not shown in FIG. 3) well known to those skilled in the art at its upper end. When the firing head 144 has been released from the slickline 156, a delay period is initiated, upon completion of which detonation of the perforating gun 142 occurs. The slickline 156 may be pulled from the well during the delay period.

The delay period is initiated by application of weight, previously suspended by the slickline 156, to the firing head 144. Specifically, the firing head 144 includes a displacing assembly 160 telescopingly disposed relative to a stationary assembly 162. If, as shown in FIG. 3, the displacing assembly 160 is suspended directly by the slickline 156, then the weight of the displacing assembly is used to initiate the delay period. Of course, the firing head 144 could be differently constructed, for example, so that the weight of the stationary assembly 162, or another weight, may be used to initiate the delay period, without departing from the principles of the present invention.

After the delay period has been initiated, thereby actuating the firing head, the slickline 156 or other conveyance is retrieved from the well. Upon completion of the delay period, a detonator (not shown in FIG. 3) in the firing head 144 is detonated, causing detonation of the perforating gun 142 and thereby perforating the casing 146 opposite the formation 148. The perforating gun 142 and gun hanger 151 may then be retrieved from, or dropped to the bottom of, the well along with the firing head.

After actuation of the firing head 144, it may be desired to safely retrieve the firing head, stop the delay mechanism without detonating the detonator, prevent detonation of the perforating gun 142, etc. Each of these objectives may be accomplished, even though the delay period has been initiated, by again suspending the applied weight so that the delay mechanism stops. For example, the slickline 156 may be lowered into the well with the fishing tool 158 to latch onto the fishing neck 18 or 18*a* of the firing head 10 or 90. The firing head 144 may then be lifted out of engagement with the perforating gun 142 and safely retrieved to the earth's surface.

Of course, modifications, additions, deletions, substitutions and other changes may be made to the firing heads 10, 90, 144 and method 140 described above, which changes would be obvious to a person of ordinary skill in the art, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A firing head operatively positionable within a subterranean well, the firing head comprising:

a first assembly telescopingly disposed relative to a second assembly; and a fluid metering device, the metering device regulating displacement of the first assembly relative to the second assembly, and the fluid metering device initially causing the first assembly to displace at a first rate relative to the second assembly, and subsequently permitting the first assembly to displace relative to the second assembly at a second rate greater than the first rate.

2. The firing head according to claim 1, wherein the first assembly has a variable weight, the first assembly weight urging the first assembly to displace relative to the second assembly.

3. The firing head according to claim 1, wherein the weight of the first assembly forces fluid to flow through the metering device.

4. The firing head according to claim 3, wherein the first assembly is permitted to displace relative to the second assembly without forcing fluid through the metering device when the first assembly has displaced a predetermined distance relative to the second assembly.

5. The firing head according to claim 1, wherein the first assembly includes a piston received within a bore of the second assembly.

6. The firing head according to claim 5, wherein the bore has first and second portions, the piston sealingly engaging the bore when the piston is disposed within the first portion, and fluid communication being permitted between the piston and the bore when the piston is disposed within the second portion.

7. The firing head according to claim 5, wherein the metering device is attached to the piston, the metering device regulating fluid flow through the piston.

8. The firing head according to claim 1, wherein the metering device regulates displacement of the first assembly relative to the second assembly for a predetermined distance, further displacement of the first assembly relative to the second assembly being unregulated by the metering device.

9. The firing head according to claim 1, wherein fluid is contained in the second assembly, and wherein the metering device is attached to the first assembly for displacement therewith and metering of the fluid therethrough.

10. The firing head according to claim 9, wherein the first assembly includes a piston, the piston sealingly engaging the second assembly to thereby force the fluid to flow through the metering device.

11. The firing head according to claim 10, wherein the piston sealingly engages the second assembly during a first predetermined displacement distance, and the piston permits the fluid to circumvent the metering device during a second predetermined displacement distance.

12. The firing head according to claim 10, wherein a variable radial clearance is formed between the piston and the second assembly, the clearance increasing when the piston displaces a predetermined distance relative to the second assembly.

13. The firing head according to claim 1, further comprising an elongated member displaceable with the first assembly, the member entering a bore of the second assembly and increasing a fluid pressure within the bore when the first assembly displaces a predetermined distance relative to the second assembly.

14. The firing head according to claim 13, wherein displacement of the first assembly relative to the second assembly is substantially unregulated by the metering device when the member enters the bore of the second assembly.

15. The firing head according to claim 1, further comprising a firing pin disposed within the second assembly, the first assembly causing an impact to the firing pin when the first assembly displaces a predetermined distance relative to the second assembly.

16. The firing head according to claim 15, wherein displacement of the first assembly relative to the second assembly is substantially unregulated by the metering device when the first assembly causes the impact to the firing pin.

17. Apparatus operatively positionable within a subterranean well, the apparatus comprising:

a piston assembly axially reciprocably disposed within a housing assembly having at least first and second inner diameters, the piston assembly sealingly engaging the first diameter when disposed therein, and the piston assembly being sealingly disengaged from the second diameter when disposed therein;

a weight attached to the piston assembly and forcing the piston assembly from within the first diameter, to within the second diameter of the housing assembly; and the piston assembly including a metering device regulating displacement of the piston assembly relative to the housing assembly when the piston assembly is within the first diameter.

18. The apparatus according to claim 17, further comprising a firing pin disposed relative to the housing assembly.

19. The apparatus according to claim 18, wherein the weight forces the piston assembly to impact the firing pin when the piston assembly is within the second diameter, and wherein displacement of the piston assembly relative to the housing assembly is unregulated by the metering device when the piston assembly is within the second diameter.

20. The apparatus according to claim 17, wherein the piston assembly further includes a projection configured for cooperative engagement with a receptacle disposed within the housing assembly.

21. The apparatus according to claim 20, wherein the weight forces the projection to enter the receptacle when the piston assembly is within the second diameter.

22. The apparatus according to claim 21, wherein the projection increases fluid pressure within the receptacle when the weight forces the projection to enter the receptacle.

23. A firing head for use in conjunction with an explosive device operatively positioned within a subterranean wellbore, the explosive device including a detonation receiver, the firing head comprising:

a weight;

a housing assembly having a detonator disposed therein, the housing assembly being configured for cooperative engagement with the explosive device within the wellbore, and the detonator being capable of detonating and thereby causing detonation of the detonation receiver; and a delay mechanism responsive to the weight to thereby regulate displacement of the weight relative to the housing assembly, the delay mechanism including a piston attached to the weight, a fluid chamber and a fluid metering device, the metering device restricting flow of fluid from the chamber.

24. The firing head according to claim 23, wherein the piston is sealingly and reciprocably disposed within the chamber.

25. The firing head according to claim 24, wherein the metering device restricts flow of the fluid through the piston.

26. The firing head according to claim 25, wherein the chamber includes a bore radially enlarged relative to the piston, the piston being capable of reciprocable displacement within the bore without causing flow of the fluid through the metering device.

27. A method of detonating an explosive device within a subterranean well, the method comprising the steps of:

positioning the explosive device within the well;

providing a firing head including a weight and a delay mechanism responsive to the weight, the delay mechanism including a piston attached to the weight, the piston being sealingly received within a fluid chamber, and a metering device for regulating fluid flow from the chamber; and then engaging the firing head with the explosive device within the well.

28. The method according to claim 27, wherein the engaging step further includes initiating the delay mechanism upon engagement of the firing head with the explosive device.

29. The method according to claim 28, wherein the initiating step comprises applying the weight to the delay mechanism.

30. The method according to claim 27, further comprising the step of lowering the firing head into the well with the weight suspended relative to the delay mechanism.

31. The method according to claim 30, wherein the engaging step further comprises releasing the weight from suspension relative to the delay mechanism, thereby activating the delay mechanism.

32. A method of detonating an explosive device, comprising the steps of:

biasing a piston to sealingly displace within a first bore of a housing assembly, displacement of the piston within the first bore being restricted by a fluid metering device; and then permitting substantially unrestricted displacement of the piston relative to the housing assembly.

33. The method according to claim 32, wherein in the biasing step restricted displacement of the piston within the first bore is performed for a predetermined time period.

34. The method according to claim 33, wherein the biasing step further comprises applying a weight to the piston, the predetermined time period varying in relation to the weight.

35. The method according to claim 32, wherein the permitting step is performed by permitting the piston to enter a second bore of the housing assembly.

* * * * *